United States Patent [19]

Dozono et al.

[11] 4,422,431

[45] Dec. 27, 1983

[54] EXHAUST GAS RECIRCULATION SYSTEM FOR INTERNAL COMBUSTION ENGINE

[75] Inventors: Kichihiko Dozono, Yokosuka; Yoji Hasegawa, Yokohama, both of Japan

[73] Assignee: Nissan Motor Company, Ltd., Yokohama, Japan

[21] Appl. No.: 343,852

[22] Filed: Jan. 29, 1982

[30] Foreign Application Priority Data

Feb. 8, 1981 [JP] Japan ..... 56-22659

[51] Int. Cl.[3] ..... F02M 25/06

[52] U.S. Cl. ..... 123/568; 123/569

[58] Field of Search ..... 123/568, 569

[56] References Cited

U.S. PATENT DOCUMENTS 4,033,306 7/1977 Sugihara et al. ..... 123/568

4,116,182 9/1978 Bradshaw ..... 123/568

*Primary Examiner*—Wendell E. Burns

*Attorney, Agent, or Firm*—Schwartz, Jeffery, Schwaab, Mack, Blumenthal & Koch

[57] ABSTRACT

In an exhaust gas recirculation system for an internal combustion engine having an intake manifold in which a throttle valve is disposed and an exhaust gas conduit provided with a particle trap for accumulatively catching particles entrained by exhaust gas discharged from the engine, a control valve apparatus which is disposed in a recirculation passage and connected to the intake manifold downstream of the throttle valve and to the exhaust gas conduit upstream of the particle trap. The control valve apparatus comprises a first control means which is adapted for controlling the exhaust gas recirculation on the basis of the vacuum pressure prevailing in the intake manifold downstream of the throttle valve, and a second control means which is adapted for cooperating with the first control means to maintain optimum exhaust gas recirculation despite an increase in the pressure of the exhaust gas caused by clogging of the particle trap.

5 Claims, 3 Drawing Figures

EXHAUST GAS RECIRCULATION SYSTEM FOR INTERNAL COMBUSTION ENGINE

BACKGROUND OF THE INVENTION

1. Field of the Invention

The present invention relates to an exhaust gas recirculating system for an internal combustion engine. In particular, the invention concerns an apparatus for controlling recirculation of the exhaust gas in dependence on pressure prevailing in an intake pipe of the internal combustion engine.

2. Description of the Prior Art

In general, the internal combustion engine for motor vehicles is provided with an exhaust gas recirculating system through which a part of exhaust gas discharged from the internal combustion engine (hereinafter also referred to simply as engine) is recirculated or fed back to the engine with a view to decreasing the content of nitrogen oxides ($NO_x$) carried by the exhaust gas by lowering the maximum temperature of combustion taking place in the engine to thereby suppress production of nitrogen oxides.

In order to have a better understanding of the invention, a hitherto known exhaust gas recirculating system will first be described by referring to FIG. 1 of the accompanying drawings. In this figure, reference numeral 1 denotes an intake conduit or manifold leading to the intake ports of an internal combustion engine (not shown), and numeral 2 denotes an exhaust manifold or pipe extending from the discharge side of the engine. It will be noted that the exhaust pipe 2 is connected to the intake conduit 1 through an exhaust gas recirculating passage 3 in which a recirculation control valve assembly generally denoted by a numeral 4 is disposed. The recirculation control valve assembly 4 is composed of a valve 5 adapted to be closed or opened for controlling flow of exhaust gas recirculated or fed back to the engine and a diaphragm device 6 serving as an actuator for driving the valve 5 in a direction to open or close the exhaust gas recirculation passage 3. The diaphragm type valve actuator 6 includes a partition diaphragm 6A which divides the inner space of a housing of the valve actuator 6 into a lower chamber 16 and an upper chamber 7. The lower chamber 16 is communicated to the atmosphere through an opening 16A, while the upper chamber 7 is communicated to the intake passage or manifold 1 through a vacuum pressure passage or pipe 8 which is opened in the intake passage 1 at a position downstream of and in the vicinity of a throttle valve 9. More particularly, the passage 8 is opened at such a location which is positioned upstream of the throttle valve 9 in the fully closed state thereof while taking a position downstream of the throttle valve 9 when the latter is opened more or less. Thus, the upper diaphragm chamber 7 is applied with a vacuum pressure prevailing in the intake conduit 1. Reference numeral 18 denotes a bias spring which is so set that a desired rate of recirculation can be attained.

With the arrangement of the exhaust gas recirculation system described above, it will be seen that the quality of exhaust gas flow fed back to the engine is varied in dependence on the vacuum pressure prevailing in the intake passage 1 downstream of the throttle valve 9. More particularly, when the vacuum pressure in the intake passage 1 is increased due to a decreased opening degree of the throttle valve 9, the valve element 5 is displaced upwardly by the diaphragm 6A to allow the flow of recirculated gas to be correspondingly increased. In this manner, in low and intermediate load ranges of the engine where the opening degree of the throttle valve 9 is relatively small, the valve 5 is opened to a greater degree to permit a correspondingly increased recirculation of the exhaust gas.

In conjunction with the exhaust gas recirculation system described above, it should be mentioned that a fine particle trap device known as a filter trap or the like for catching or trapping fine particles entrained by the exhaust gas is installed in the exhaust pipe at a position downstream of the recirculating passage 3 in some types of the internal combustion engines such as Diesel engine, for example. In this connection, it will readily be understood that as the trapping of particles proceeds, the filter trap device is gradually clogged, and as a result the gas transmitivity of the filter trap device is progressively reduced so that resistance to the exhaust gas flow is correspondingly increased, thus giving rise to an increase in the exhaust gas pressure in the exhaust pipe upstream of the trap device. Under the circumstances, the differential pressure appearing across the valve 5 is also increased correspondingly, thus resulting in a relatively high ratio of exhaust gas recirculation. In other words, the presence of the fine particle trap device will cause the recirculation ratio to be deviated from the optimum value as time elapses. This is of course a problem or difficulty to be eliminated.

SUMMARY OF THE INVENTION

It is therefore an object of the present invention to provide an improved exhaust gas recirculation system for an internal combustion engine provided with a fine particle trap device for trapping fine particles entrained by exhaust gas of the engine, in which the problem described above is solved in a satisfactory manner.

Another object of the present invention is to provide an exhaust gas recirculation system of the type mentioned above which allows the exhaust gas recirculation flow rate to be maintained constantly at an optimum or desired value notwithstanding the provision of a particle trap in the exhaust pipe of the engine.

In view of the above and other objects which will become more apparent as description proceeds, it is proposed according to an aspect of the present invention that the exhaust gas recirculation control valve apparatus which is operated in response to the vacuum pressure prevailing in an intake passage or manifold of the engine at a location downstream of and in the vicinity of the throttle valve is controlled correctively as a function of the exhaust gas pressure prevailing in the exhaust pipe or manifold at a location upstream of the exhaust particle trap filter in such a manner that the recirculation control valve is driven in the direction to close the recirculation passage as the exhaust gas pressure in the exhaust pipe upstream of the particle trap filter is increased beyond a predetermined level.

DETAILED DESCRIPTION OF THE PREFERRED EMBODIMENTS

Figure 1:
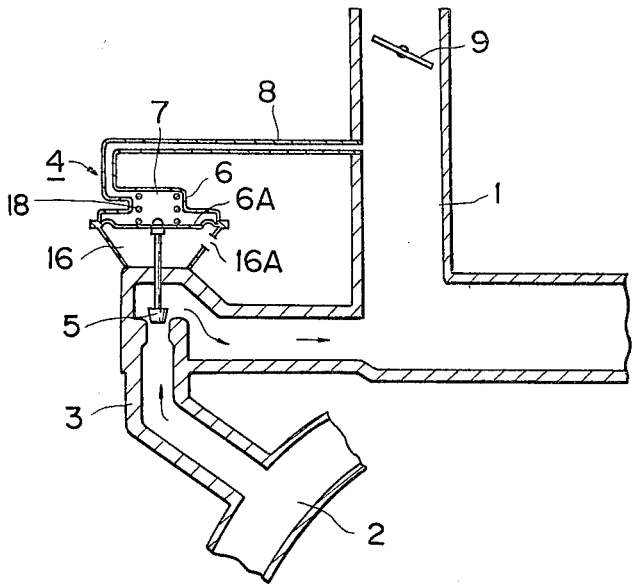
FIG. 1 (PRIOR ART)
FIG. 1 is a schematic sectional diagram to illustrate a hitherto known exhaust gas recirculation system for an internal combustion engine.

The invention will now be described in detail in connection with embodiments thereof illustrated in the drawings.

Figure 2:
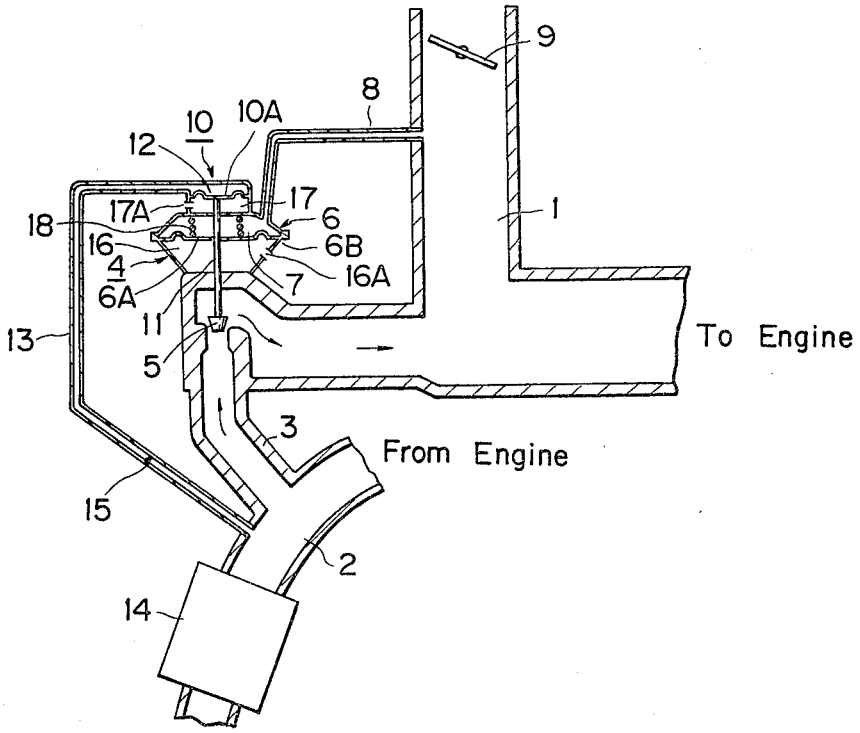
FIG. 2 is a schematic sectional diagram to illustrate an exhaust gas recirculation system according to an embodiment of the present invention.

Referring to FIG. 2 which shows a first embodiment of the invention and in which components equivalent or similar to those shown in FIG. 1 are denoted by the same reference symbols, a particle trap 14 for trapping or catching fine particles such as soots or smoke particles entrained by the exhaust gas discharged from an internal combustion engine (not shown) is disposed at the exhaust gas passage or manifold 2. The trap 14 may be of any conventional type such as filter trap, cyclon type trap or the like. The exhaust gas pipe 2 is connected to the intake passage or manifold 1 leading to engine cylinders (not shown) through the exhaust gas recirculation conduit or passage 3 which is branched from the exhaust gas passage 2 at a location upstream of the particle trap 14. An exhaust gas recirculation control valve apparatus generally denoted by numeral 4 and composed of a valve element 5 and a diaphragm type valve actuator 6 is provided in the exhaust gas recirculation passage 3. The diaphragm type valve actuator 6 comprises a housing 6B the inner space of which is partitioned by a flexible diaphragm 6A to define an upper chamber 7 and a lower chamber 16, wherein the upper chamber 7 is communicated to the intake passage 1 through a control pressure passage 8, while the lower chamber 16 is communicated to the atmosphere through an opening 16A. The control pressure passage 8 is opened in the intake passage 1 at a location downstream of a throttle valve 9 in the vicinity thereto in the same manner as described hereinbefore in conjunction with FIG. 1. A bias spring 18 exerts a predetermined bias pressure onto the diaphragm 6A. It will be recalled that the exhaust gas recirculation control valve apparatus 4 constituted by the valve 5 and the diaphragm type valve actuator 6 functions to effect the recirculation of the exhaust gas through the engine at a desired or optimum level in dependence on the vacuum pressure prevailing in the intake passage 1 downstream of the throttle valve 9 in the manner described hereinbefore by referring to FIG. 1.

According to the teaching of the present invention, there is provided an apparatus for correctively regulating the exhaust gas recirculation control effected by the exhaust gas recirculation control valve apparatus 4 mentioned above in consideration of pressure increase in the exhaust pipe or passage 2 as caused by the presence of the particle trap 14 for the reason described above. In the case of the embodiment illustrated in FIG. 2, this apparatus is constituted by a second diaphragm apparatus 10 including a flexible diaphragm 10A and disposed on the first diaphragm apparatus 6. An upper chamber 12 of the second diaphragm apparatus 10 partitioned by the diaphragm 10A is communicated to the exhaust gas pressure 2 at a location upstream of the particle trap 14 through a passage or conduit 13, while a lower diaphragm chamber 17 is communicated to the atmosphere through an opening 17A. It should be noted that both the diaphragm 6A and the second diaphragm 10A are mechanically coupled to the valve element 5 in a tandem array by means of a valve stem 11. The conduit or passage 13 is provided with a restriction 15 which serves to smooth pulsations in the exhaust gas pressure transmitted to the second diaphragm apparatus 10.

In the arrangement described just above, the exhaust gas recirculation control valve apparatus 4 is so designed that a predetermined quantity of exhaust gas recirculation which depends substantially upon the vacuum pressure prevailing downstream of the throttle valve 9 is established when the exhaust gas pressure is lower than a predetermined value. Thus, when the engine is in a low or medium load state in which the opening degree of the throttle valve 9 is relatively small, the vacuum pressure acting onto the upper chamber 7 of the diaphragm device 6 is increased, as a result of which the valve 5 is displaced upwardly, as viewed in FIG. 2, to an extent corresponding to the increase in the vacuum pressure, thus correspondingly increasing the exhaust gas recirculation.

When transmitivity of the particle trap 14 to the exhaust gas flow is reduced as the fine particles such as soots are progressively accumulated in the trap 14, thus giving rise to a corresponding increase in the exhaust gas pressure in the exhaust conduit 2 upstream of the trap 14, the pressure difference appearing across the recirculation control valve 5 will be increased by an amount corresponding to the increment in the exhaust gas pressure. As a result, the exhaust gas recirculation tends to be increased. However, such a tendency is suppressed by the fact that the increased pressure in the exhaust gas passage 2 upstream of the trap 14 is applied to the second diaphragm apparatus 10 through the passage 13. More specifically, the increased pressure in the exhaust gas passage 2 as caused by the clogging of the trap 14 is transmitted to the upper chamber 12 of the second diaphragm apparatus 10 and exerts a force to the diaphragm 10A, whereby the valve 5 is displaced in such a direction as to reduce the outlet area of the passage 3 so that optimum exhaust gas recirculation can always be maintained despite the increase in the exhaust gas passage 2.

Figure 3:
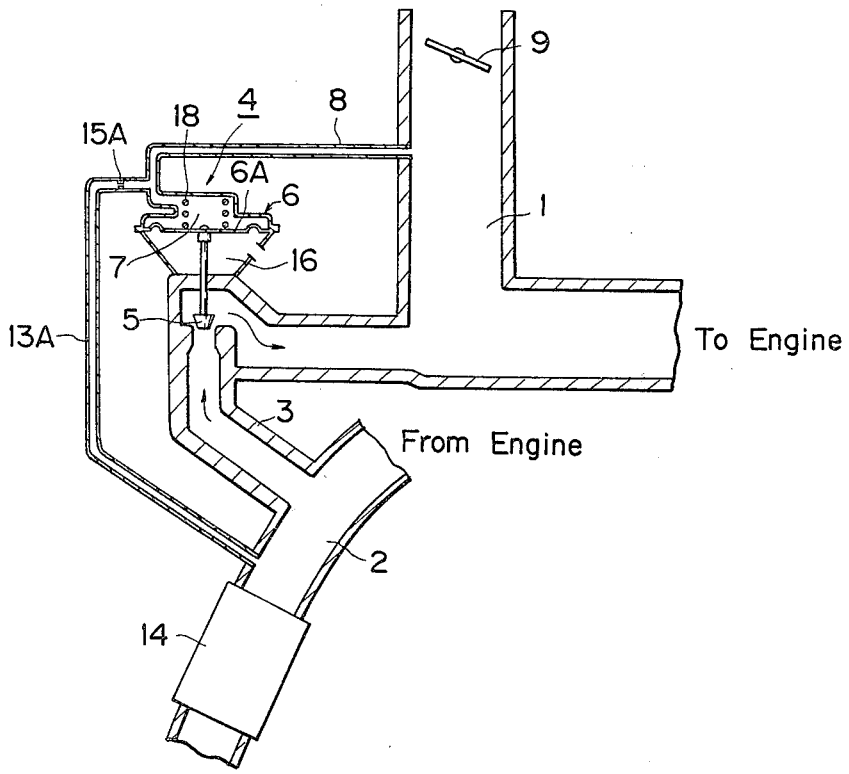
FIG. 3 is a view similar to FIG. 2 and shows another exemplary embodiment of the invention.

Referring to FIG. 3, there is shown the exhaust gas recirculation system according to another embodiment of the present invention. In this embodiment, the exhaust gas recirculation control valve assembly 4 is provided with a single diaphragm device 6. The upper chamber 7 of the diaphragm device 6 is communicated with the exhaust gas passage 2 upstream of the trap 14 through the passage 13A provided with a restriction 15A, and also with the intake manifold 1 downstream of the throttle valve 9 through the passage 8. With such an arrangement, if the exhaust gas pressure is increased for such a reason as mentioned earlier with reference to FIG. 2, then the increased exhaust gas pressure is transmitted to the upper chamber 7 of the diaphragm device 6 through the passage 13A, together with the vacuum pressure from the intake manifold 1 through the passage 8, so that the valve 5 is displaced in the same direction as in FIG. 2 to such an extent as determined by the addition of the aforementioned two pressures. In this way, according to this embodiment, too, optimum exhaust gas recirculation can always be maintained despite the increase in the exhaust gas pressure. As will be readily appreciated, according to the embodiment shown in FIG. 3, similar advantageous effects to those of the apparatus shown in FIG. 2 can be produced with a simplified structure.

From the foregoing description, it will now be appreciated that the invention has provided an improved exhaust gas recirculation system for internal combustion engines which can maintain the exhaust gas recirculated through the engine at optimum or desired flow rate even if the exhaust gas pressure within the exhaust pipe is increased due to the clogging of the particle trap provided in the exhaust pipe.

Although the invention has been described in conjunction with the specific embodiments thereof illustrated in the accompanying drawings, it should be understood that the invention is by no means restricted to them and that various modifications and changes will readily occur to those skilled in the art without departing from the spirit and scope of the invention set forth in the claims.

We claim:

1. In an internal combustion engine including an intake passage provided with a throttle valve, and an exhaust gas passage provided with a particle trap for catching particles entrained by exhaust gas discharged from said internal combustion engine, an exhaust gas recirculation system comprising:

an exhaust gas recirculation passage connected between said intake passage at a position downstream of said throttle valve and said exhaust gas passage at a position upstream of said particle trap so as to permit recirculation of the exhaust gas to said intake passage therethrough;

a control valve means provided in said exhaust gas recirculation passage for controlling the recirculation of the exhaust gas to said intake passage through said exhaust gas recirculation passage; and a valve actuator means operatively coupled for controlling said control valve means, said valve actuator means being responsive to a vacuum pressure prevailing in said intake passage at a region downstream of said throttle valve and upstream of the position where said exhaust gas recirculation passage is connected to said intake passage and also responsive to a pressure prevailing in said exhaust gas passage at a region upstream of said particle trap, thereby causing said control valve means to be actuated to control the recirculation of the exhaust gas substantially in dependence on said intake passage vacuum pressure, while at the same time ensuring the the recirculation of the exhaust gas controlled by said control valve means is substantially insusceptible to the pressure of the exhaust gas in said exhaust gas passage being increased beyond a predetermined level as a result of said particle trap being clogged.

2. An exhaust gas recirculation system according to claim 1 wherein said valve actuator means comprises:

a first diaphragm chamber communicated with said intake passage at said region downstream of said throttle valve and upstream of the position where said exhaust gas recirculation passage is connected to said intake passage, said first diaphragm chamber having a first flexible diaphragm connected to said control valve means for enabling said control valve means to be actuated, following movement of the diaphragm, in the direction to open said exhaust gas recirculation passage when said vacuum pressure in said intake passage is increased; and a second diaphragm chamber communicated with said exhaust gas passage upstream of said particle trap and having a second flexible diaphragm connected to said control valve means for preventing said control valve means from being actuated in the direction to open said exhaust gas recirculation passage in response to the pressure of the exhaust gas in said exhaust gas passage being increased beyond said predetermined level as the result of the clogging of said particle trap.

3. An exhaust gas recirculation system according to claim 2 wherein said second diaphragm chamber is connected to said exhaust gas passage upstream of said particle trap through a passage provided with a restriction.

4. An exhaust gas recirculation system as set forth in claim 1, wherein said valve actuator means includes a diaphragm chamber communicated to said intake passage at said region and having a flexible diaphragm connected to said control valve means so that movement of said control valve means follows movement of said diaphragm in such a manner that said control valve means is moved in the direction to open said recirculation passage when said vacuum pressure at said region is increased, and wherein said valve actuator means includes a passage which communicates said diaphragm chamber to said exhaust gas passage at a location upstream of said particle trap.

5. An exhaust gas recirculation system as set forth in claim 4, wherein said passage communicating said diaphragm chamber to said exhaust gas passage includes a restriction.

* * * * *